US007587983B2

(12) United States Patent
Parker et al.

(10) Patent No.: US 7,587,983 B2
(45) Date of Patent: Sep. 15, 2009

(54) DRIVE MECHANISM FOR A TRACK MOUNTED BODY

(75) Inventors: Brian Maurice Parker, Edwardstown (AU); George Giles Campbell, Hilton (AU)

(73) Assignee: Glidestore Freetrack Pty Ltd, South Australia (AU)

( * ) Notice: Subject to any disclaimer, the term of this patent is extended or adjusted under 35 U.S.C. 154(b) by 455 days.

(21) Appl. No.: 10/508,977

(22) PCT Filed: Mar. 26, 2003

(86) PCT No.: PCT/AU03/00360

§ 371 (c)(1),
(2), (4) Date: Apr. 25, 2005

(87) PCT Pub. No.: WO03/079851

PCT Pub. Date: Oct. 2, 2003

(65) Prior Publication Data

US 2006/0163184 A1 Jul. 27, 2006

(30) Foreign Application Priority Data

Mar. 26, 2002 (AU) ..... PS1361

(51) Int. Cl.
*B61C 9/00* (2006.01)

(52) U.S. Cl. ..... 105/30; 105/33; 211/162; 104/242

(58) Field of Classification Search ..... 104/243, 104/163, 168; 105/30, 32, 33, 75, 89, 95, 105/101, 26.1; 211/162, 113, 94.01; 312/198; 474/101, 116

See application file for complete search history.

(56) References Cited

U.S. PATENT DOCUMENTS

| | | | | | |
|---|---|---|---|---|---|
| 3,698,326 | A | * | 10/1972 | Schurch et al. | 105/156 |
| 3,944,309 | A | | 3/1976 | Taniwaki | |
| 4,023,503 | A | * | 5/1977 | Grop | 105/30 |
| 4,417,524 | A | * | 11/1983 | Quinn et al. | 105/101 |
| 4,559,027 | A | * | 12/1985 | Sattel | 474/116 |
| 6,112,917 | A | * | 9/2000 | Baker et al. | 211/162 |

FOREIGN PATENT DOCUMENTS

| | | | | |
|---|---|---|---|---|
| AU | 76190/98 | A | | 2/1999 |
| DE | 1 258 344 | | | 1/1968 |
| EP | 0779047 | A | | 6/1997 |
| GB | 934891 | A | | 8/1963 |
| GB | 1233393 | | | 5/1971 |
| GB | 2 122 960 | | * | 1/1984 |
| JP | 20022265017 | | | 9/2002 |
| WO | WO 9802063 | A | | 1/1998 |
| WO | 03097491 | A1 | | 11/2003 |

* cited by examiner

*Primary Examiner*—Mark T Le
(74) *Attorney, Agent, or Firm*—The Webb Law Firm

(57) ABSTRACT

A drive mechanism for a body where the body has a plurality of load bearing and track engaging wheels that allow the body to move back and forth along a track that comprises an actuator attached to the body that is manually or mechanically driven, a non-load beating drive wheel that is attached with respect to the body so that it engages a stationary surface adjacent the body and a drive coupling mechanism between the actuator and the drive wheel wherein actuation of the actuator causes rotation of the drive wheel which moves the body along the tracks. The invention provides a convenient mechanism of attaching a drive mechanism to a body and to enable easier movement of track mounted bodies.

30 Claims, 5 Drawing Sheets

DRIVE MECHANISM FOR A TRACK MOUNTED BODY

This invention relates to a drive mechanism for a track mounted body and in particular to a mechanism that enables movement of the body along the tracks without the use of a load bearing drive wheel.

BACKGROUND OF THE INVENTION

1. Field of the Invention

An example of where the invention will find application are track mounted shelving or cabinet units. Such shelving units are designed to provide compact storage by having the shelving units abut against one another with only one access opening being provided within which the shelves can be accessed. The shelves can be separated by moving them along the track to open up access at different points along the assembled shelves.

2. Description of the Related Art

In many instances, shelves are moved manually although it is common to provide a manual crank mechanism or electric drive means to move the shelves. This is particularly necessary when each shelving unit carries a heavy load.

The conventional means of providing a drive to each of the shelves is to connect the track mounted wheels to some form of drive means. This means that an axle extends across the base of each shelf to which the wheels are mounted. The shaft is then connected to some form of independent drive means which may be a manually rotated handle or an electric motor driven through a reduction gear box.

The need to mount a shaft within the base of the shelf unit results in added cost and complexity to the shelving unit. It would be desirable to have a drive mechanism that could be easily fitted to shelving units that were designed to be manually moved. Accordingly, it is an object of this invention to provide such an arrangement that meets this objective and overcomes the above mentioned problems.

SUMMARY OF THE INVENTION

In one form, the invention is a drive mechanism for a body, wherein said body has a plurality of load bearing track engaging wheels that allow said body to move back and forth along a track, that comprises,

- an actuator attached to said body that is manually or mechanically driven,
- a non-load bearing drive wheel that is attached with respect to said body so that it engages a stationary surface adjacent said body, and
- a drive coupling means between said actuator and said drive wheel wherein actuation of said actuator means causes rotation of said drive wheel which moves said body along said tracks.

The above invention avoids the need to have a drive axle mounted through the base of each shelf unit. In addition, it enables a simple arrangement to be attached to an existing shelf unit to convert it from a shelf unit that needs to be manually pushed along the tracks to a unit that incorporates a drive mechanism.

The actuator preferably is a manually rotated capstan wheel or a crank but the drive wheel could equally be driven by an electric motor via a reduction gear box.

The drive wheel applies force to move the body by pushing against the surface or ground on which the body is mounted. Preferably, the periphery of the drive wheel comprises a high friction material such as a polyurethane material and surface against which the periphery of the wheel engages may also be roughened or have a high coefficient of friction to avoid slippage of the drive wheel.

Preferably, the drive coupling between the actuator and drive wheel includes reduction gearing. The gearing can include many different types of components such as tooth belts, v-belts, meshing gear wheels and the like. One preferred arrangement is the use of a first belt that extends from the drive shaft towards the base of the body. This belt drives a first pulley wheel that in turn drives a second pulley wheel and there is a belt that extends from the second pulley to a pulley wheel that is attached to the drive wheel which in turn rotates the drive wheel.

In order to fully understand the invention, a preferred embodiment will be described. However, it should be realised that the invention is not necessarily restricted to the precise details of this embodiment. In particular, the embodiment is described in relation to application of the invention to a shelving system. However, there may be other applications to which the invention could be equally suited.

BRIEF DESCRIPTION OF THE DRAWINGS

The invention is illustrated in the accompanying drawings in which.

DETAILED DESCRIPTION OF THE PREFERRED EMBODIMENTS

Figure 1:
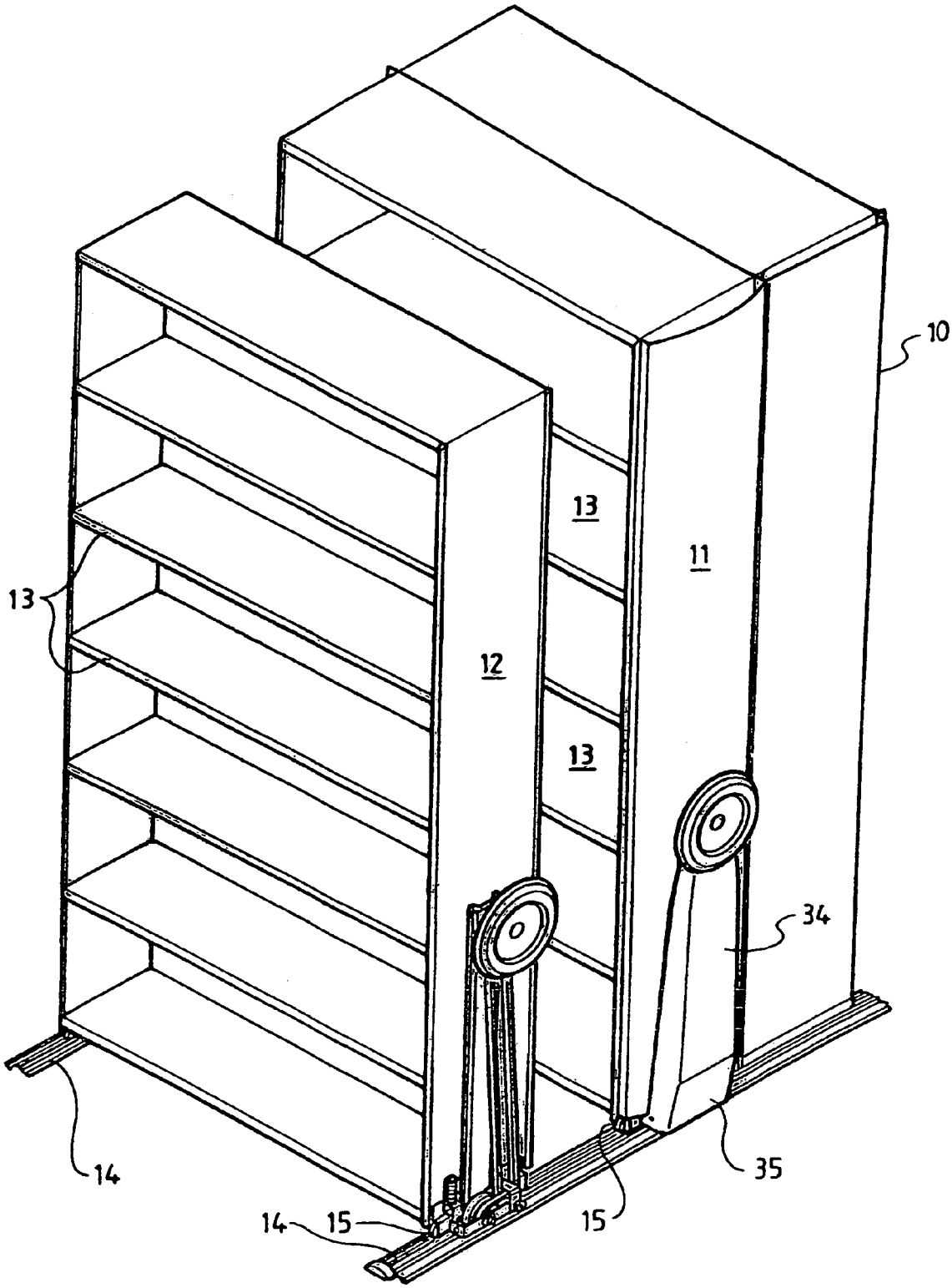
FIG. 1 shows three shelf units, two of which are track mounted.

Referring to FIG. 1, there are three shelf units 10, 11 and 12 with shelves 13. Shelf units 11 and 12 are mounted to load bearing tracks 14 via wheels 15. Tracks 14 provide a longitudinal recess within which the wheels 15 locate. A pair of wheels 15 are used at each side of the shelf units 11 and 12 and are rotatably mounted about a horizontal axis within a housing which is attached at each side of the unit 11 and 12.

The shelf unit 10 is an end shelf unit and therefore is fixed with respect to the tracks 14. Shelf units 11 and 12 are moved along the tracks 14 to provide access between various pairs of shelves. For example, shelf unit 11 can be moved so as to open up access between shelf unit 11 and 10.

Figure 2:
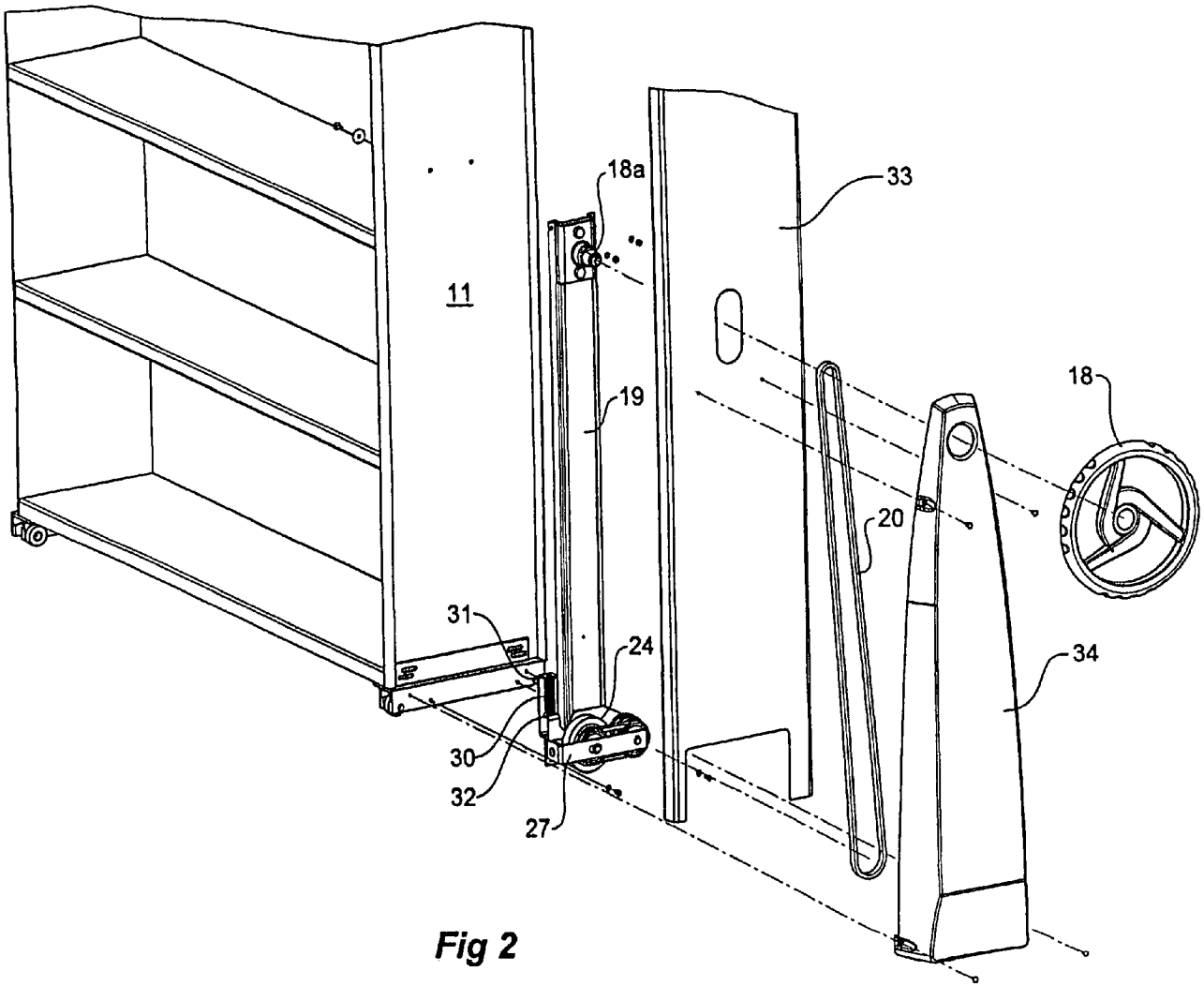
FIG. 2 shows an exploded view of a drive mechanism and covers that are attached to the side of a shelf unit.
Figure 3:
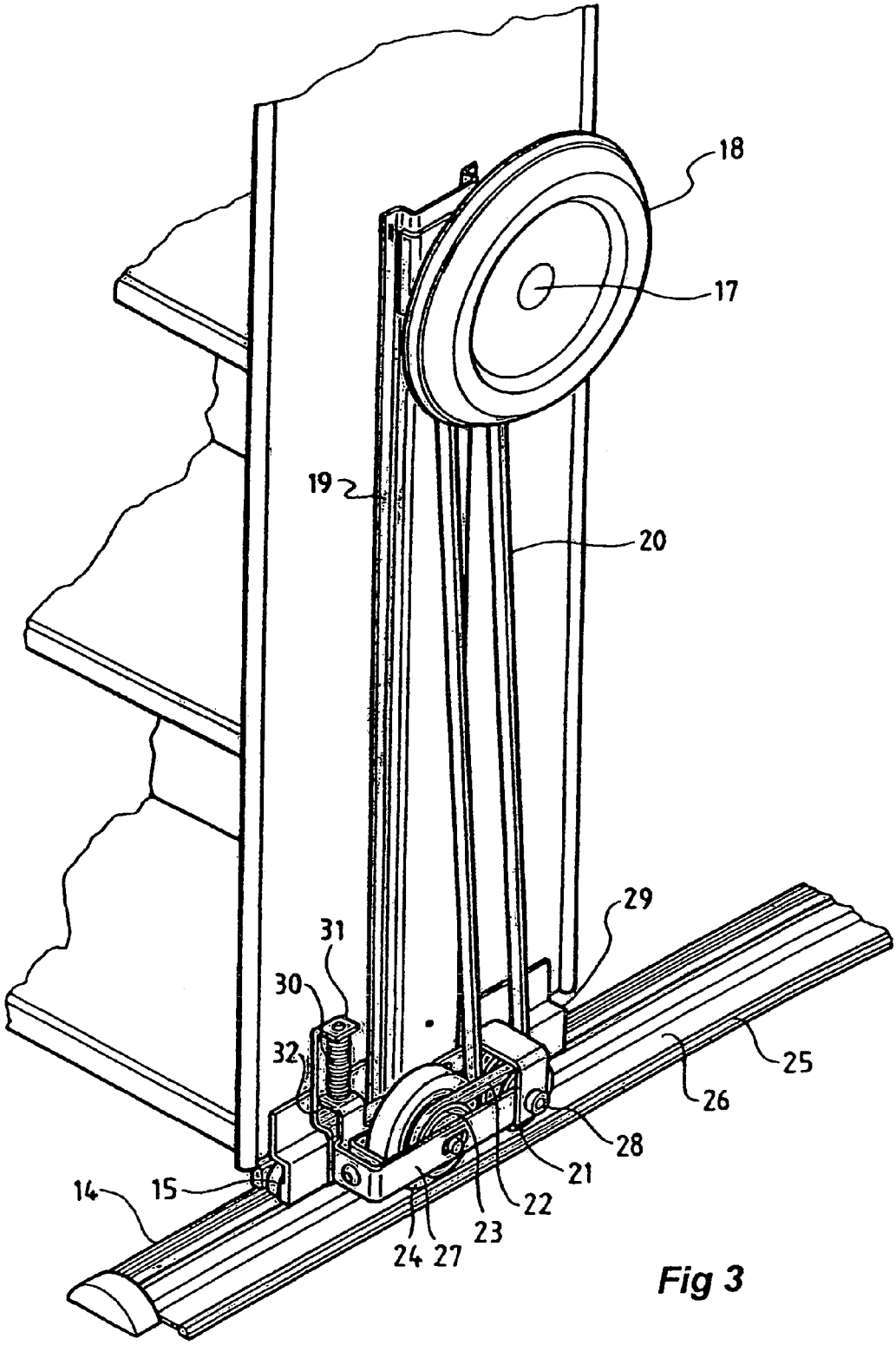
FIG. 3 shows a perspective view of an assembled drive mechanism attached to the side of a shelf unit.
Figure 4:
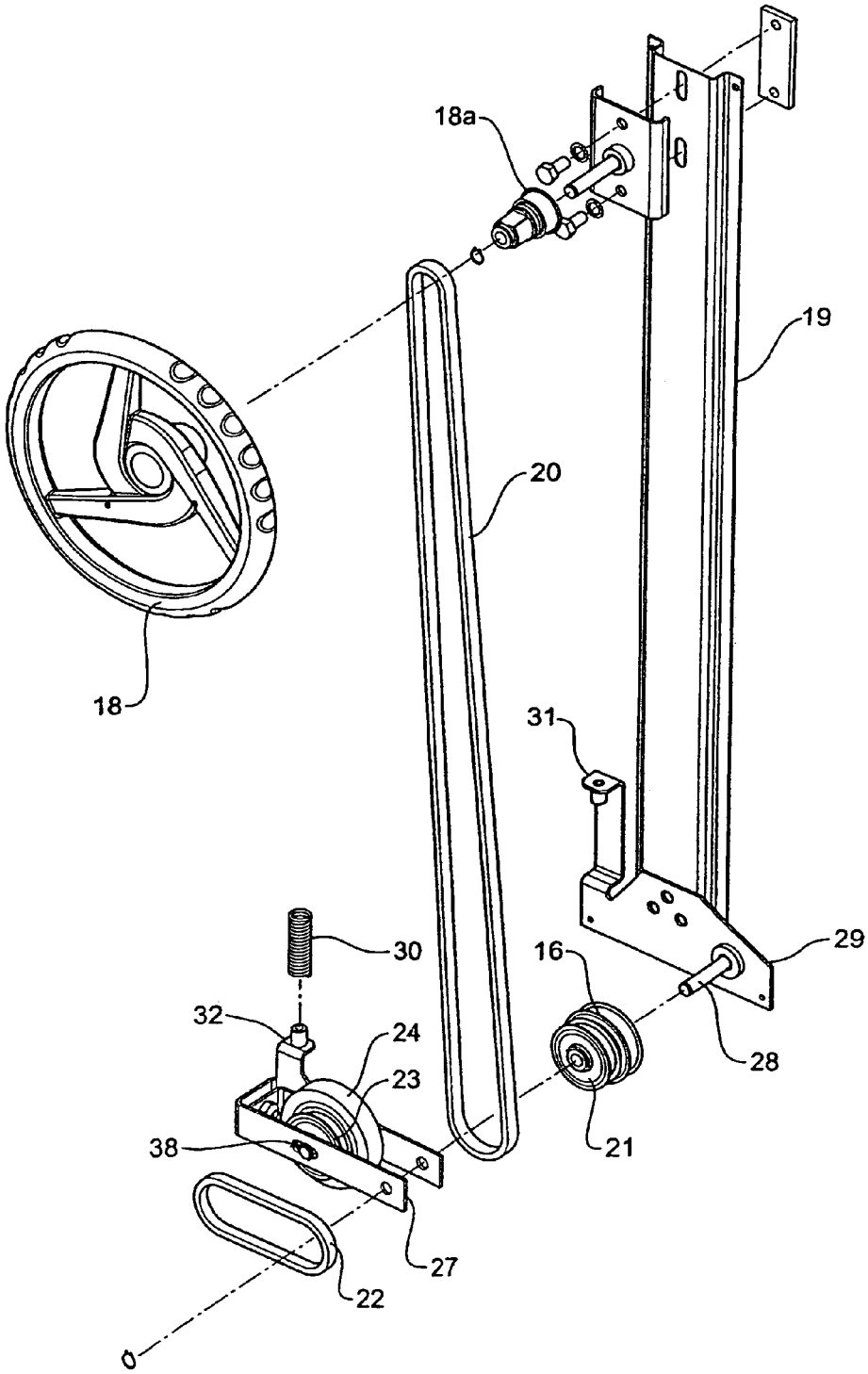
FIG. 4 shows an exploded view of a drive mechanism.

FIGS. 2, 3 and 4 show more detailed views of the drive mechanism. It has an actuator that comprises a drive shaft 17 to which a hand operated wheel 18 is attached. The drive shaft 17 is rotatably secured to a column 19 with column 19 attached to the side of the shelf unit.

A first drive belt 20 extends from a pulley wheel 18*a* on the wheel 18 downwardly to a carriage 27 that is located towards the base of the shelf unit 11 and 12. The belt 20 is an internal tooth belt and the pulley wheel 18*a* on the wheel 18 is toothed to engage with the belt 20. For ease of drafting purposes, the teeth on the belt 20 and pulley wheels are not drawn.

The carriage 27 has mounted to it a first pulley wheel set comprising a first pulley wheel 16 and a second pulley wheel 21. In addition, the drive wheel 24 is also mounted within the carriage 27. The belt 20 locates around the first pulley wheel 16 which is connected to the second pulley wheel 21. A second tooth belt 22 locates around the second pulley wheel 21 and drives a third pulley wheel 23 which is connected to the drive wheel 24. As can be seen from the drawings, the first pulley wheel 16 is a larger diameter than the second pulley wheel 21. The combination of the pulley wheel 18*a* on the handle 18 and its diameter difference with the first pulley wheel 16 and the diameter difference between the pulley wheel 16 and the second pulley wheel 21 provides the required reduction in gearing.

Figure 5:
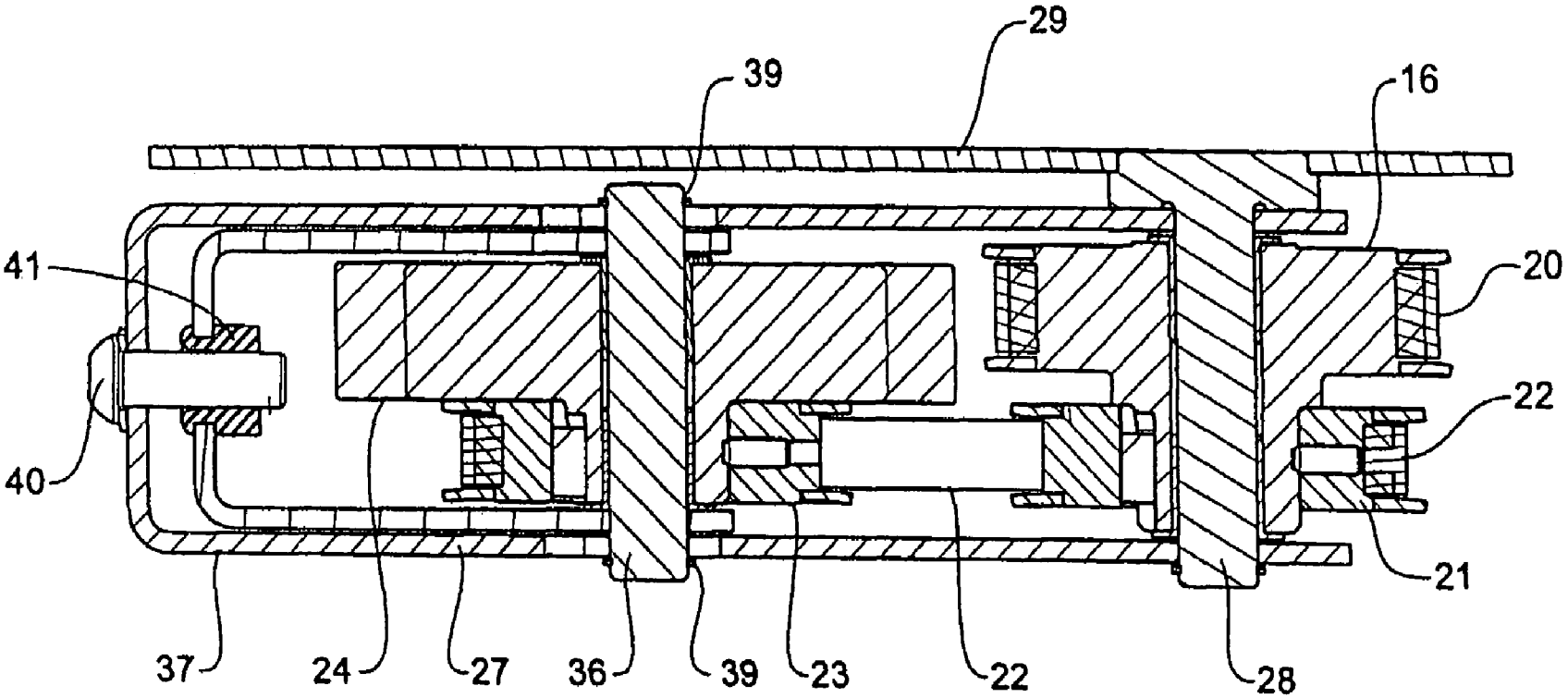
FIG. 5 shows a cross-section of a carriage within which gearing and the drive wheel are mounted.

The carriage 27, having the drive wheel 24 mounted therein, is pivotally attached to the side of the shelf unit via a pivot connection 28 that is located entirely outward of the side or outer wall of the body of the shelving unit (see FIGS. 3-5). In this embodiment the pivot connection 28 is secured to a plate 29 that is attached to the column 19 and the side of the shelving unit 11 and 12.

The carriage 27 is a u-shaped bracket between which the first and second pulley wheels 16 and 21 and the drive wheel 24 and third pulley drive wheel 23 are rotatably mounted. The axle 36 of the drive wheel 24 is rotatably mounted about a horizontal axis to an inner carriage 37. The inner carriage 37 locates within the carriage 27. Elongate slots 38 are provided in the carriage 27 through which the ends of the axle 36 locate. Circips 39 are located on each end of the axle 36 and retain the axle 36 within the carriage 37. This enables the inner carriage 37 to slide with the carriage 27 and this movement is controlled by threaded bolt 40 which locates within a nut 41 in the end of the inner carriage 37. Rotation of the bolt 40 enables the inner carriage 37 to be moved to enable tightening the belt 22.

The drive wheel 24 and the wheel 15 on a side of the shelf unit 11,12 are mounted for rotations about respective horizontal axes separate from the pivot connection 28.

A spring 30 applies a downward force to the carriage 27 so that the carriage 27 is rotated in an anti clockwise direction. This acts to force the drive wheel 24 against the linear strip 26 of the drive wheel track and to tighten belt 20. A bracket 31 is part of the plate 29 and the carriage 27 has a flange 32 that locates beneath the bracket 31. The spring 30 is held under compression between the bracket 31 and the flange 32 so that the necessary rotated force is applied to the carriage 27. The bracket 31 and flange 32 are on one side of the carriage 27. However, they may be located centrally over the carriage 27 so that no eccentric force is applied to the carriage. This will prevent side loading being applied to the drive wheel 24.

The drive wheel track 25 is preferably co-extruded with the track 14 and extends parallel to and horizontally alongside the track 14. The linear strip 26 of the drive wheel track 25 is preferably roughened or has an abrasive strip adhered to it. The drive wheel 24 preferably has a polyurethane tyre which, in combination with the linear strip 26, provides maximum grip. This grip, in combination with the force applied by the spring 30 is sufficient to ensure that the drive wheel 24 does not slip with respect to the linear strip 26.

Although this preferred embodiment uses a track 25, which is distinct from the load bearing tracks 14, the invention would equally work without such a track where the drive wheel 24 engages a floor such as a linoleum surface.

The advantage of the pivotally mounted carriage 27 is that a perfectly level track is not required. The floor surface or track 25 may have undulations which are accommodated by the spring 30 and movement of the carriage 27.

As seen in FIG. 2, a first cover 33 locates over the side of the shelf units 11 and 12 over the column 19 and a second cover 34 locates over the first cover 33 and extends from the handle 18 down to and over the carriage 27.

The gearing ratio gives adequate speed of movement of the shelving unit while at the same time not requiring excessive effort to be applied to the hand operated wheel 18.

It will be clear from the above description that the invention provides a unique means of providing a drive mechanism for track mounted bodies such as shelf units. The drive mechanism does not make use of a load bearing wheel and does not require the installation of an axle through the base of the unit moving along the track.

The design is useful in that it can be manufactured so as to fit to units that are designed to be manually moved. However, the design could equally be incorporated into the shelving unit rather than being a bolt on assembly.

The invention claimed is:

1. A drive mechanism for attachment to an existing body having an outer wall, wherein said body has a plurality of load bearing track engaging wheels that allow said body to move back and forth along a load bearing track, said drive mechanism comprising:

an actuator attached outward of said outer wall of said body that is driven, a non-load bearing drive wheel mounted to pivot by a pivot connection that is located entirely outward of said outer wall of said body and with respect to said body so that it engages a stationary surface adjacent said body, said stationary surface being distinct from said load bearing track, said drive wheel and said actuator located on the same side of said load bearing track and outward of said outer wall of said body, and a drive coupling mechanism between said actuator and said drive wheel wherein actuation of said actuator causes rotation of said drive wheel which moves said body along said load bearing tracks, wherein the load bearing track engaging wheels and the non-load bearing drive wheel are rotatably mounted about respective horizontal axes separate from said pivot connection, and wherein said stationary surface extends parallel to and horizontally alongside said load bearing track.

2. The drive mechanism according to claim 1, wherein said drive wheel frictionally engages said surface.

3. The drive mechanism according to claim 2, wherein the periphery of said drive wheel comprises a material having a high friction co-efficient.

4. The drive mechanism according to claim 3, wherein said material comprises polyurethane.

5. The drive mechanism according to claim 1, further comprising a mechanism of biasing said drive wheel towards said surface.

6. The drive mechanism according to claim 5, wherein said biasing mechanism comprises a carriage to which said drive wheel is mounted that is pivotally mounted with respect to said body and a spring mounted between said carriage and said body that urges said carriage towards said surface.

7. The drive mechanism according to claim 1, further comprising reduction gearing between said actuator and said drive wheel.

8. The drive mechanism according to claim 1, wherein said drive coupling comprises a belt extending between said actuator and said drive wheel.

9. The drive mechanism according to claim 8, further comprising an intermediate pair of pulleys with said belt extending to a first of said pulleys with a second belt extending from a second of said pulleys to said drive wheel.

10. The drive mechanism according to claim 1, wherein said actuator comprises a manually operated crank.

11. The drive mechanism according to claim 10, wherein said crank comprises a wheel.

12. A plurality of track mounted cabinets using a drive mechanism according to claim 1, wherein each said cabinet comprises a body with said drive mechanism attached to each said cabinet.

13. The track mounted cabinets according to claim 12, wherein said surface is an elongate track extending along the length of said cabinets that is engaged by said drive wheel.

14. The track mounted cabinets according to claim 13, wherein said elongate track is attached to any one of load bearing tracks supporting said cabinets.

15. The drive mechanism according to claim 1, wherein said actuator is manually driven.

16. The drive mechanism according to claim 15, wherein said actuator is mechanically driven.

17. A drive mechanism for attachment to an existing body having an outer wall, wherein said body has a plurality of load bearing track engaging wheels that allow said body to move back and forth along a load bearing track, said drive mechanism comprising:

a non-load bearing drive wheel mounted to pivot by a pivot connection that is located entirely outward of said outer wall of said body and with respect to said body so that it frictionally engages a stationary surface adjacent said body, said surface being distinct from said load bearing track, and a drive for rotating said drive wheel to move said body along said load bearing tracks, wherein said drive and said drive wheel are located on the same side of said load bearing track and outward of said outer wall of said body, wherein the load bearing track engaging wheels and the non-load bearing drive wheel are rotatably mounted about respective horizontal axes separate from said pivot connection, and wherein said stationary surface extends parallel to and horizontally alongside said load bearing track.

18. A plurality of track mounted cabinets using a drive mechanism according to claim 17, wherein each said cabinet comprises a body with said drive mechanism attached to each said cabinet.

19. The track mounted cabinets according to claim 18, wherein said surface is an elongate track extending along the length of said cabinets that is engaged by said drive wheel.

20. The track mounted cabinets according to claim 19, wherein said elongate track is attached to any one of load bearing tracks supporting said cabinets.

21. The drive mechanism according to claim 17, wherein said drive mechanism further comprises a mechanism for biasing said drive wheel towards said surface.

22. The drive mechanism according to claim 21, wherein said drive comprises:

an actuator attached to said body that is manually or mechanically driven; and a drive coupling mechanism between said actuator and said drive wheel, wherein actuation of said actuator causes rotation of said drive wheel which moves said body along said load bearing track.

23. The drive mechanism according to claim 22, wherein a periphery of said drive wheel comprises a material having a high friction co-efficient.

24. The drive mechanism according to claim 23, wherein said material comprises polyurethane.

25. The drive mechanism according to claim 22, wherein said biasing mechanism comprises a carriage to which said drive wheel is mounted, said carriage being pivotally mounted with respect to said body, and a spring mounted between said carriage and said body that urges said carriage towards said surface.

26. The drive mechanism according to claim 22, wherein said drive coupling mechanism comprises reduction gearing.

27. The drive mechanism according to claim 22, wherein said drive coupling mechanism comprises a belt extending between said actuator and said drive wheel.

28. The drive mechanism according to claim 27, further comprising an intermediate pair of pulleys with said belt extending to a first of said pulleys and with a second belt extending from a second of said pulleys to said drive wheel.

29. The drive mechanism according to claim 22, wherein said actuator comprises a manually operated crank.

30. The drive mechanism according to claim 29, wherein said crank comprises a wheel.

* * * * *

UNITED STATES PATENT AND TRADEMARK OFFICE

CERTIFICATE OF CORRECTION

PATENT NO. : 7,587,983 B2
APPLICATION NO. : 10/508977
DATED : September 15, 2009
INVENTOR(S) : Parker et al.

It is certified that error appears in the above-identified patent and that said Letters Patent is hereby corrected as shown below:

Cover of the Patent, See Item (56), References Cited, U.S. PATENT DOCUMENTS, add the following:

-- 4,467,924 8/1984 Morcheles . . . . . 211/1.5 --

Cover of the Patent, See Item (57), ABSTRACT, line 5, "non-load beating" should read -- non-load bearing --

Signed and Sealed this

Second Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,587,983 B2
APPLICATION NO. : 10/508977
DATED : September 15, 2009
INVENTOR(S) : Parker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 791 days.

Signed and Sealed this

Twenty-first Day of September, 2010

David J. Kappos

David J. Kappos
*Director of the United States Patent and Trademark Office*